US008805221B2

(12) United States Patent
Okada

(10) Patent No.: US 8,805,221 B2
(45) Date of Patent: Aug. 12, 2014

(54) IMAGE FORMING APPARATUS

(71) Applicant: Canon Kabushiki Kaisha, Tokyo (JP)

(72) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 13/675,031

(22) Filed: Nov. 13, 2012

(65) Prior Publication Data

US 2013/0136464 A1 May 30, 2013

(30) Foreign Application Priority Data

Nov. 30, 2011 (JP) ..... 2011-262595

(51) Int. Cl.
*G03G 15/08* (2006.01)

(52) U.S. Cl.
USPC ..... 399/53; 399/50; 399/281

(58) Field of Classification Search
USPC ..... 399/49, 44, 53, 274, 55, 281, 50
See application file for complete search history.

(56) References Cited

U.S. PATENT DOCUMENTS

| | | | | |
|---|---|---|---|---|
| 7,013,095 | B2 | 3/2006 | Ishida | |
| 7,164,868 | B2 | 1/2007 | Ishida | |
| 2003/0091356 | A1 * | 5/2003 | Komatsu et al. | 399/49 |
| 2004/0223776 | A1 | 11/2004 | Ishida | |
| 2006/0110174 | A1 | 5/2006 | Ishida | |

FOREIGN PATENT DOCUMENTS

| | | | |
|---|---|---|---|
| JP | 10-39608 | A | 2/1998 |
| JP | 2003-156890 | A | 5/2003 |
| JP | 2004-271920 | A | 9/2004 |
| JP | 2007-78896 | A | 3/2007 |
| JP | 2008-191213 | A | 8/2008 |

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus includes photosensitive drums, electrostatic latent image forming units, developing sleeves, patch detection sensors which detect image densities of the toner images formed by the electrostatic latent image forming units, and toner replenishment units which replenish the developing sleeves with the toner based on the detection results of the patch detection sensors. Further, controllers are provided to control the rotation speeds of the developing sleeves at the time of forming the reference toner image to be higher than the rotation speeds of the developing sleeves at the time of forming a normal image.

5 Claims, 19 Drawing Sheets

FIG. 5B

| | DEVELOPING SLEEVE ROTATION SPEED (mm/s) | | |
|---|---|---|---|
| | 450(Def) | 600 | 750 |
| STABILITY OF PATCH DETECTION | DETERIORATION | ← | IMPROVEMENT |
| STABILITY OF DENSITY | DETERIORATION | ← | IMPROVEMENT |
| GRANULARITY OF IMAGE | IMPROVEMENT | → | DETERIORATION |
| REPRODUCIBILITY OF HORIZONTAL LINE | IMPROVEMENT | → | DETERIORATION |
| TONER SCATTERING | IMPROVEMENT | → | DETERIORATION |
| DEVELOPER LIFESPAN | IMPROVEMENT | → | DETERIORATION |

| | DEVELOPING BIAS Vpp | | |
|---|---|---|---|
| | 1.3KV | 1.6KV | 1.9KV |
| STABILITY OF PATCH DETECTION | DETERIORATION | | IMPROVEMENT |
| STABILITY OF DENSITY | DETERIORATION | | IMPROVEMENT |
| RING MARK | IMPROVEMENT | | DETERIORATION |
| FOGGING | IMPROVEMENT | | DETERIORATION |
| TONER SCATTERING | IMPROVEMENT | | DETERIORATION |

FIG. 12B

IMAGE FORMING APPARATUS

BACKGROUND OF THE INVENTION

1. Field of the Invention

The present invention relates to an image forming apparatus such as a copying machine and a printer, in which an electrophotographic system or an electrostatic recording system is employed.

2. Description of the Related Art

Conventionally, there is provided an image forming apparatus using a two-component developer. The two-component developer includes toner and carriers, of which a TD ratio representing a ratio of the toner to the carriers changes as the toner is consumed when image forming is progressed. As a result, toner charging characteristics vary, and thus an image density varies. For this reason, the toner is replenished in order to suppress the variation in the image density.

As a method for the toner replenishment control, there is a method of stabilizing the toner charging characteristics, which is called a patch detection ATR control (see Japanese Patent Laid-Open No. 10-039608). In the method, an image pattern (a patch image) for detecting the image density is formed on an electrophotographic photoreceptor. Then, the image density of the patch image is detected by an image density sensor, and a toner replenishment amount is controlled such that the detected value becomes a desired value.

However, in the patch detection ATR control, there may be a case in which an appropriate developer state is not maintained when the development characteristic of the patch image varies. For example, even in a case where the toner charging characteristics are not changed, the image density of the patch image becomes pale when the development characteristic is degraded. In this case, the patch detection ATR control is performed to increase the TD ratio, so that the image density of the patch image becomes a desired value. As a result, there is a concern that the toner charging characteristics are deteriorated, and the degradation in image quality such as granularity (roughness), fogging on a white base, and a void image due to transfer defects, and the toner scattering may occur.

For this reason, the TD ratio detecting unit such as an inductance sensor is provided in a developing device, and a limit is set in the TD ratio (see Japanese Patent Laid-Open No. 2007-78896). Accordingly, the degradation in the toner charging characteristics can be suppressed, and the image degradation and the toner scattering can be suppressed.

However, according to Japanese Patent Laid-Open No. 2007-78896, the inductance sensor is necessarily provided, and thus the cost is incurred.

SUMMARY OF THE INVENTION

It is desirable to provide an image forming apparatus which can suppress image degradation and toner scattering while keeping down the cost by suppressing variation in the development characteristic of a patch image.

In order to attain the above object, there is provided an image forming apparatus including: an image bearing member; a developing device which includes a toner bearing member which supplies toner to an electrostatic latent image formed on the image bearing member and develops a toner image; a transfer device which transfers the toner image formed by the toner bearing member onto a recording material; an image density sensor which detects an image density of a reference toner image for controlling the image density developed by the toner bearing member; a toner replenishment device which replenishes the developing device with the toner based on the detection result of the image density sensor; and a controller which makes a control such that a rotation speed of the toner bearing member at the time of forming the reference toner image is higher than the rotation speed of the toner bearing member at the time of forming a normal image.

Further features of the present invention will become apparent from the following description of exemplary embodiments with reference to the attached drawings.

BRIEF DESCRIPTION OF THE DRAWINGS

FIG. 5B is a diagram illustrating relations between the developing sleeve rotation speed and various items.

FIGS. 6A to 6D are diagrams illustrating effects according to the first embodiment, in which FIG. 6A is a diagram illustrating development efficiency of a patch image and the number of copy outputs according to the first embodiment; FIG. 6B is a diagram illustrating the detection result of a patch detecting sensor and the number of copy outputs according to the first embodiment; FIG. 6C is a diagram illustrating toner charging characteristics (Q/M) of a toner image on the photosensitive drum and the number of copy outputs according to the first embodiment; and FIG. 6D is a diagram illustrating transition in toner density of a developer (TD ratio) and the number of copy outputs according to the first embodiment.

FIG. 12B is a diagram illustrating relations between the developing bias Vpp and various items according to the third embodiment.

FIGS. 13A to 13D are diagrams illustrating effects according to the third embodiment, in which FIG. 13A is a diagram illustrating development efficiency of a patch image and the number of copy outputs according to the third embodiment; FIG. 13B is a diagram illustrating the detection result of a patch detecting sensor and the number of copy outputs according to the third embodiment; FIG. 13C is a diagram illustrating toner charging characteristics (Q/M) of a toner image on the photosensitive drum and the number of copy outputs according to the third embodiment; and FIG. 13D is a diagram illustrating transition in toner density (TD ratio) of a developer and the number of copy outputs according to the third embodiment.

DESCRIPTION OF THE EMBODIMENTS

First Embodiment

Figure 1:
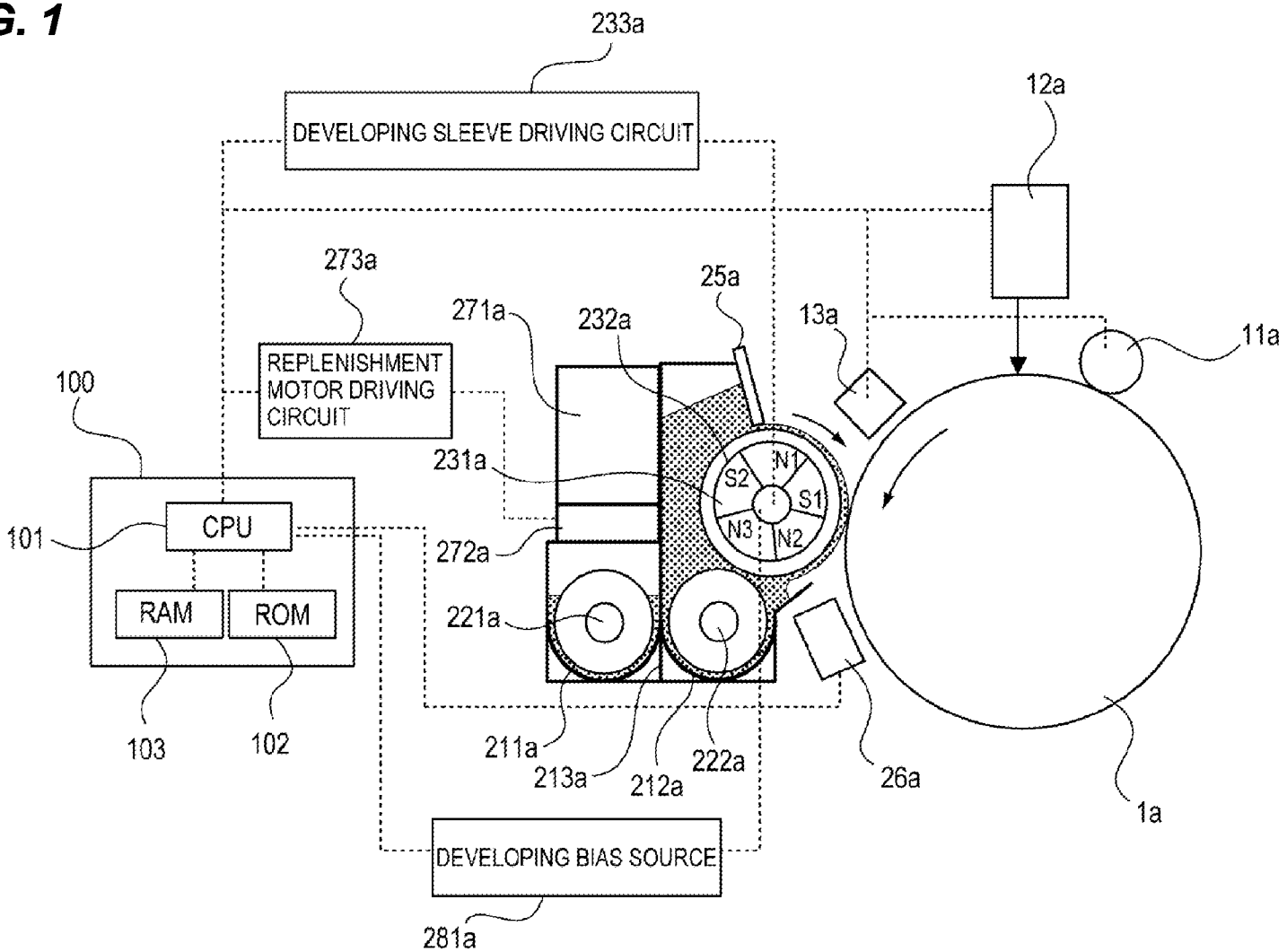
FIG. 1 is a diagram illustrating a configuration of a developing device according to a first embodiment.
Figure 2:
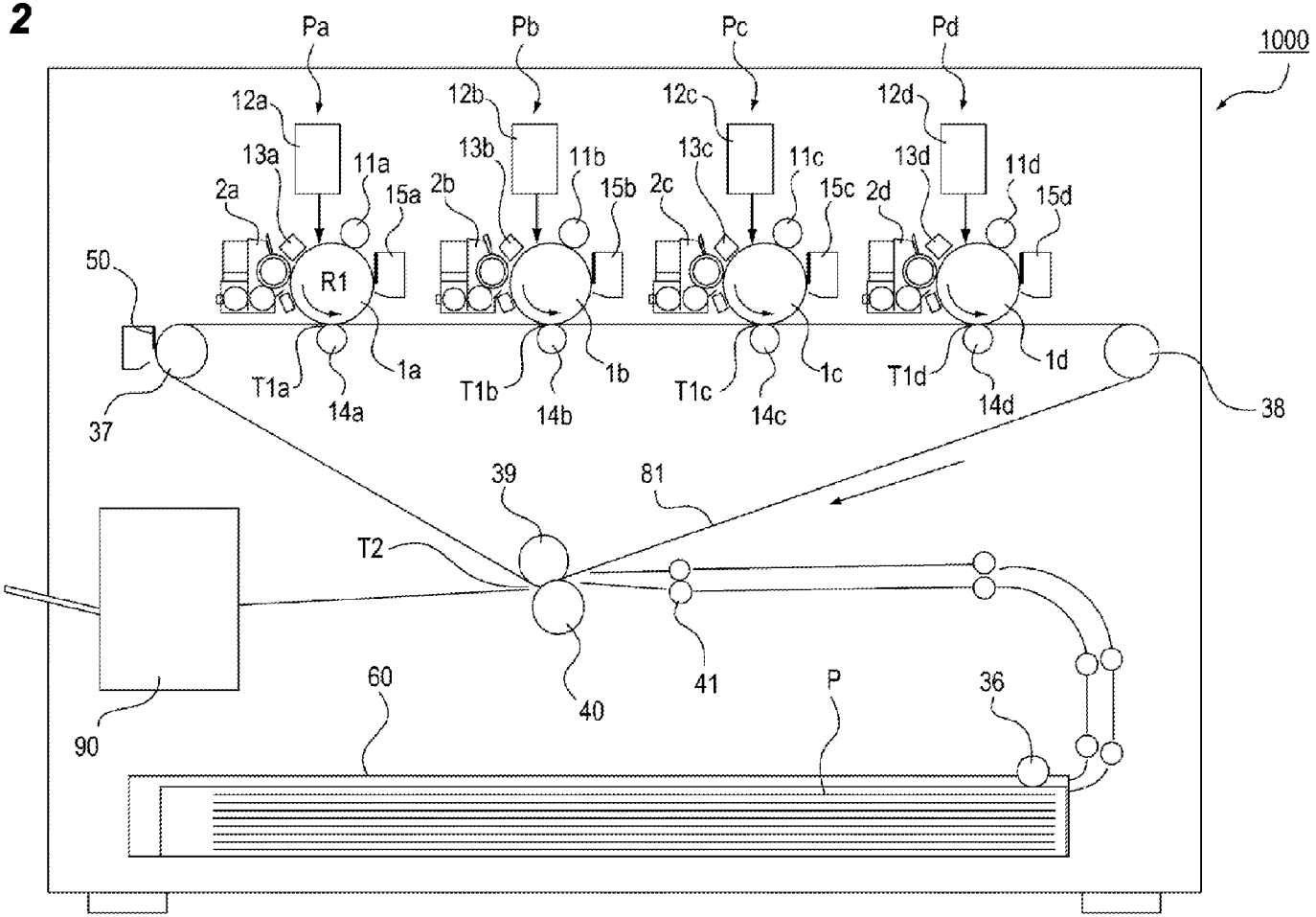
FIG. 2 is a diagram illustrating a configuration of an image forming apparatus according to the first embodiment.

An image forming apparatus according to a first embodiment of the invention will be described with reference to the accompanying drawings. FIG. 1 is a diagram illustrating a configuration of a developing device according to the embodiment. FIG. 2 is a diagram illustrating a configuration of an image forming apparatus according to the embodiment.

As illustrated in FIG. 2, the image forming apparatus 1000 according to the embodiment is configured to include four image forming units Pa, Pb, Pc, and Pd which have substantially the same configuration to each other and are disposed in series above an intermediate transfer belt 81. The intermediate transfer belt 81 is suspended by a driving roller 37, a tension roller 38, and a secondary transfer inner-roller 39.

As illustrated in FIGS. 1 and 2, a photosensitive drum (image bearing member) 1 (1*a* to 1*d*) in the image forming units Pa to Pd is applied with a bias voltage from a charging roller (electrostatic latent image forming unit) 11 (11*a* to 11*d*) to be charged uniformly. The charged photosensitive drums 1*a* to 1*d* are irradiated from a scanner unit (electrostatic latent image forming unit) 12 (12*a* to 12*d*) with a laser beam according to image information, and electrostatic latent images are formed thereon. The electrostatic latent images are developed as yellow, magenta, cyan, and black toner images by a developing device 2 (2*a* to 2*d*) using a two-component developer including non-magnetic toner and magnetic carriers.

Respective colored toner images formed in the image forming units Pa to Pd are primarily transferred on the intermediate transfer belt 81 in an overlapping manner by a primary transfer roller 14 (14*a* to 14*d*) in nip portions (primary transfer portions T1*a* to T1*d*) formed between the photosensitive drums 1*a* to 1*d* and the intermediate transfer belt 81. The residual toner left on the photosensitive drum 1*a* after the primary transfer is removed by a cleaner 15 (15*a* to 15*d*). Further, the rotation speed of the photosensitive drum 1*a* is assumed to be 300 mm/s in the embodiment. In addition, the bias voltage is applied with a DC voltage (−700 V) and an AC voltage (1.5 KVpp) overlapped with each other.

On the other hand, a sheet P taken out from a sheet cassette 60 is conveyed by a sheet feeding roller 36 and a conveying roller 41, and with the toner images being transferred thereon in a nip portion (secondary transfer portion T2) formed between the intermediate transfer belt 81 and a secondary transfer roller 40. The sheet P with the toner images transferred is heated and pressurized by a fixing device 90 to make the toner images fixed thereon, and then is discharged to the outside of the image forming apparatus 1000. The residual toner left on the intermediate transfer belt 81 after the secondary transfer is removed by the cleaner 50.

(Developing Device 2) The developing devices 2*a* to 2*d* have the same configuration to each other, and thus the description will be made on the developing device 2*a*. As illustrated in FIG. 1, the developing device 2*a* is delimited into a developing chamber 212*a* and a stirring chamber 211*a* by a partition wall 213*a*. In the developing chamber 212*a*, a non-magnetic developing sleeve (toner bearing member) 232*a* is disposed. In the developing sleeve 232*a*, a magnet (magnetic field generating unit) 231*a* is fixedly disposed.

In the developing chamber 212*a*, a first conveying screw (developer stirring/conveying unit) 222*a* is disposed. In the stirring chamber 211*a*, a second conveying screw (developer stirring/conveying unit) 221*a* is disposed. The first conveying screw 222*a* serves to stir and convey the developer of the developing chamber 212*a*. The second conveying screw 221*a* serves to stir and convey the toner supplied by a toner replenishment screw (toner replenishment unit) 272*a* from a toner replenishment tank (toner replenishment unit) 271*a* along with the developer already in the developing device 2*a* to make the toner density of the developer uniformalized. The partition wall 213*a* includes developer passages for connecting the developing chamber 212*a* and the stirring chamber 211*a* to each other formed in the end portion on the front and rear sides thereof in a direction perpendicular to a paper surface, thereby circulating the developer.

The two-component developer stirred by the first conveying screw 222*a* is trapped within a magnetic force of a pumping magnetic pole N3, and is conveyed along with the rotation of the developing sleeve 232*a*. Then, the developer is sufficiently trapped by a cut magnetic pole S2 having a magnetic flux density of some degree, and is conveyed while forming a magnetic brush.

The developer layer thickness of the magnetic brush is balanced by raking magnetic brushes with a regulating blade 25*a*, and the magnetic brush is conveyed to the developing region facing the photosensitive drum 1*a* along with the rotation of a conveyance magnetic pole N1 and the developing sleeve 232*a*. Then, the magnetic brushes are formed by a development magnetic pole S1 positioned at the developing region, the toner is transferred only onto the electrostatic latent image on the photosensitive drum 1*a* by a developing bias applied to the developing sleeve 232*a*, and a toner image is formed on the surface of the photosensitive drum 1*a* corresponding to the electrostatic latent image.

(Controller 100) A controller (a first controller, a second controller, and a third controller) 100 includes a CPU 101, a ROM 102, and a RAM 103. The ROM 102, which is connected to the CPU 101, stores control data for controlling a sleeve rotation driving circuit 233*a*, a developing bias source 281*a*, and a replenishment motor driving circuit 273*a*.

In the embodiment, the rotation speed of the developing sleeve 232*a* is set to 450 mm/s, and the CPU 101 controls the rotation speed in a variable manner through the sleeve rotation driving circuit 233*a*. In addition, the developing sleeve 232*a* uses a developing bias voltage obtained by overlapping the DC voltage (DevDC=−600 V) and the AC voltage (DevAC=1.3 KVpp) from the developing bias source 281*a*, and the CPU 101 controls the developing bias voltage in a variable manner through the developing bias source 281*a*. In addition, the CPU 101 controls the rotation of the toner replenishment screw 272*a* through the replenishment motor driving circuit 273*a*, and thereby controls a toner replenishment amount.

(Toner Replenishment Control) Since the toner density of the developer in the developing device 2*a* decreases as the electrostatic latent image is developed, a toner replenishment control (patch detection ATR) is performed. In the toner replenishment control, during the forming of continuous images, the CPU 101 first forms a patch latent image (the reference electrostatic latent image for controlling the image density) which is an image pattern for detecting the image density in a non-image region (inter-image) positioned between the images to be output on the photosensitive drum 1.

In the embodiment, the surface potential on the photosensitive drum 1*a* at the time of forming the patch latent image is controlled to be −500 V, and the development is performed in the condition that the developing bias is −600 V and a potential difference therebetween is 100 V. Then, the surface potential of the patch latent image is detected using a surface potential sensor 13*a*, and the intensity L of the laser beam from the scanner unit 12*a* is controlled to make the detected value constant. The intensity L of the laser beam can be changed within a range from 0 to 255, and the potential of the electrostatic latent image is changed along with the change in the intensity L of the laser beam. In the embodiment, it is assumed that the value of the surface potential sensor 13*a* is represented by V(L) (V(L=0) to V(L=255)) when the laser beam intensity L is changed from 0 to 255.

The image density of the patch image (the reference toner image) Q obtained by developing the patch latent image is detected by a patch detection sensor (an image density detecting unit) 26*a*. The patch detection sensor 26*a* is disposed to face the photosensitive drum 1, and detects the quantity of reflection light from the toner image formed on the photosensitive drum 1*a*, thereby optically detects the image density of the toner image.

The detection result of the patch detection sensor 26*a* is input to the CPU 101 which calculates a patch density using a density conversion table stored in the ROM 102 to obtain a correction amount of the replenishment toner estimated as a desired density (the quantity of reflection light). Then, based on the obtained correction amount, the toner is replenished from the toner replenishment tank 271*a* to the developing device 2*a* by the controller 100, the replenishment motor driving circuit 273*a*, and the toner replenishment screw 272*a*. Therefore, the toner density of the developer is controlled as constant as possible, so that the image density is controlled as constant as possible.

Specifically, in the beginning, a density Dp(init) of the patch image Q in the developer at the initial time is measured as an initialization mode and is stored in the RAM 103 (a patch detection initialization). In operation of the image forming apparatus, the toner replenishment is performed such that the density Dp of the patch image Q becomes Dp(init).

For example, when the density Dp(init) of the patch image Q in the developer at the initial time has been 400, and the density Dp(X) of the patch image Q measured after the image forming apparatus outputs the X-th image becomes 350, it indicates that the density of the patch image Q becomes low compared with the initial state. In the embodiment, when the density Dp(init) is 400, the toner amount on the photosensitive drum 1 is 0.30 mg/cm$^2$, and when the density Dp(X) is 350, the toner amount on the photosensitive drum 1 is reduced to 0.26 mg/cm$^2$. A relation between the density Dp(X) and the toner amount on the photosensitive drum 1 is stored in the ROM 102 in advance.

In a case of Dp(X)=350, the density of the patch image is necessarily restored up to Dp(init)=400, and thus it needs to perform the toner replenishment at the time of outputting the (X+1)-th image. The toner replenishment amount M(X+1) for the (X+1)-th image is determined using Dp(init), Dp(X), and a replenishment coefficient M(reference) previously stored in the ROM 102 as follows.

$$M(X+1)=(Dp(\text{init})-Dp(X))\times M(\text{reference}) \quad \text{(Equation 1)}$$

Based on Equation 1, in a case of M(X+1)>0, the density of the patch image Q is considered to be lowered compared with the initial state, and thus the toner replenishment is performed by an amount determined by Equation 1. In a case of M(X+1)≤0, the density of the patch image Q is considered not to be lowered compared with the initial state, and thus the toner replenishment is not performed. Therefore, the toner is replenished through the above control.

Figure 3:
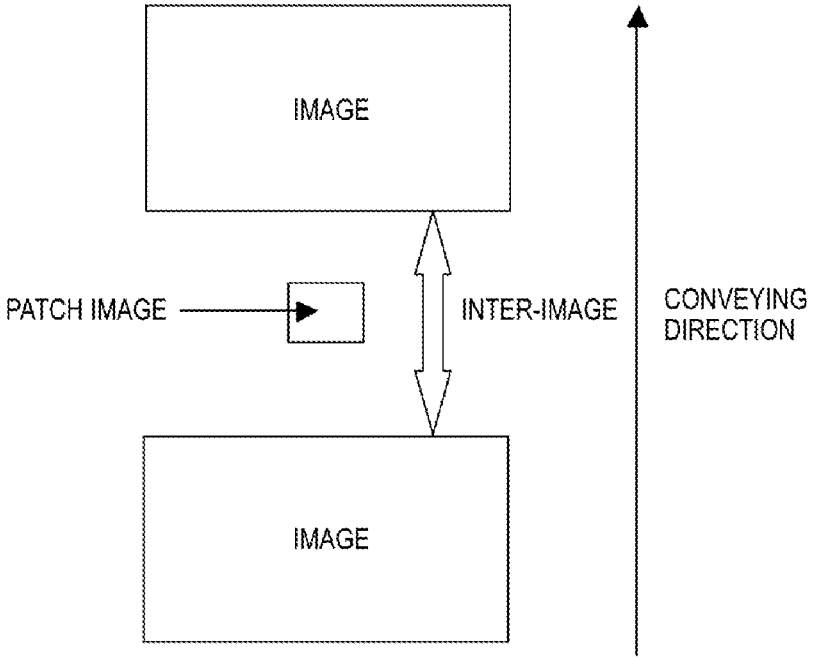
FIG. 3 PRIOR ART
FIG. 3 is a diagram illustrating a position of a patch image in the related art.

(Conventional Toner Replenishment Control) In the conventional toner replenishment control, as illustrated in FIG. 3, one patch latent image is formed under the same condition for forming a latent image between the images to form the patch image. In a case where the patch latent image is formed under the same condition for forming a latent image, the toner density of the developed patch image is constant as long as the states of the development characteristic and the developer are not changed.

Figures 4A, 4B, 4C, 4D:
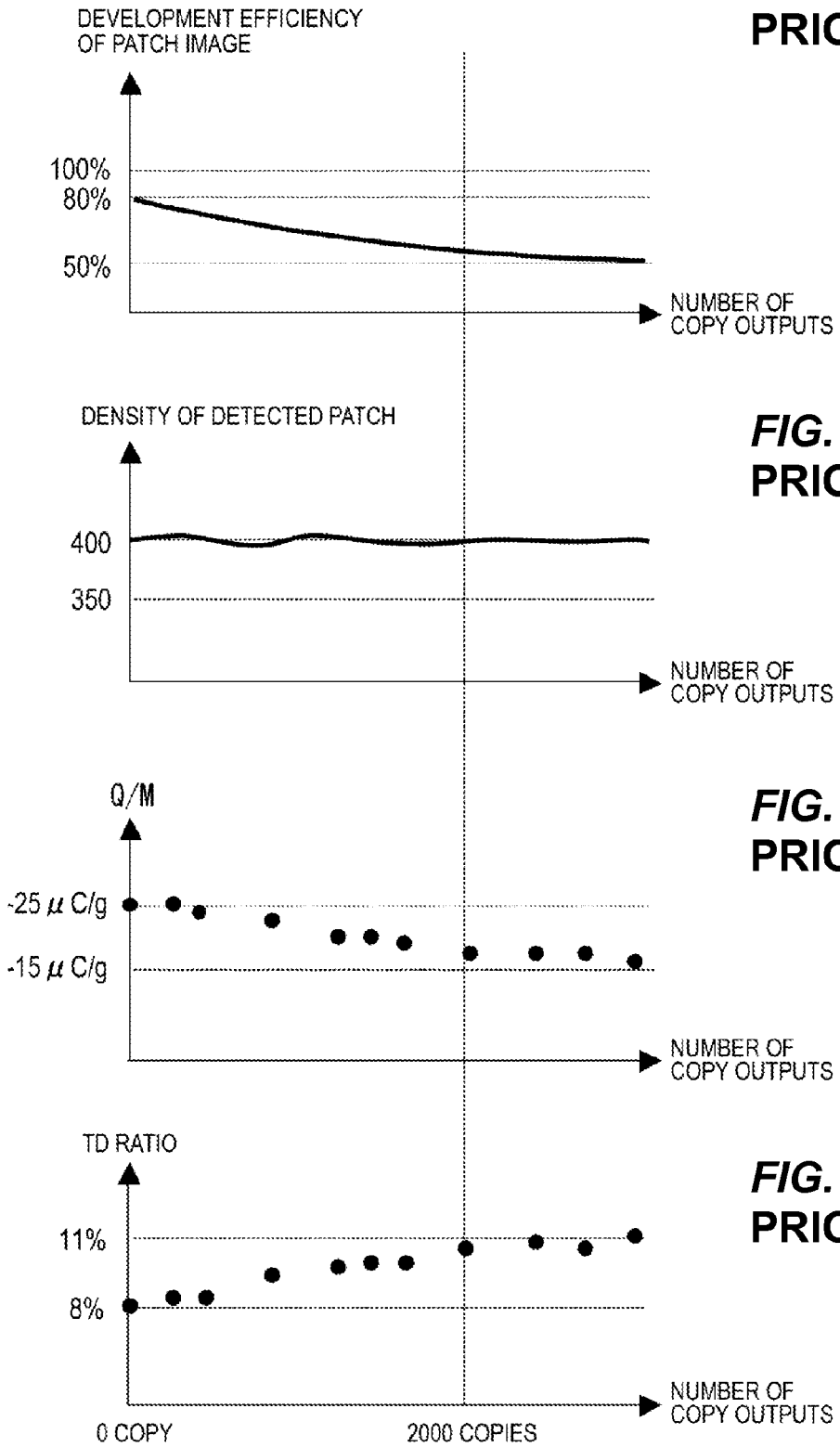
FIG. 4A PRIOR ART
FIG. 4B PRIOR ART
FIG. 4C PRIOR ART
FIG. 4D PRIOR ART
FIG. 4A is a diagram illustrating development efficiency of the patch image and the number of copy outputs in the related art.
FIG. 4B is a diagram illustrating the detection result of a patch detecting sensor and the number of copy outputs in the related art.
FIG. 4C is a diagram illustrating toner charging characteristics (Q/M) of a toner image on a photosensitive drum and the number of copy outputs in the related art.
FIG. 4D is a diagram illustrating transition in toner density (TD ratio) of a developer and the number of copy outputs in the related art.

However, the development characteristic of the patch image may vary, so that the toner charging characteristics (Q/M) is difficult to be controlled in an appropriate range. FIGS. 4A to 4D illustrate specific verification results. FIG. 4A is a diagram illustrating development efficiency of the patch image and the number of copy outputs. FIG. 4B is a diagram illustrating the detection result of the patch detecting sensor 26*a* and the number of copy outputs. FIG. 4C is a diagram illustrating toner charging characteristics (Q/M) of the toner image on the photosensitive drum 1 and the number of copy outputs. FIG. 4D is a diagram illustrating transition in toner density (TD ratio) of a developer and the number of copy outputs.

The rotation speed of the developing sleeve 232*a* upon the validation is 450 mm/s. An image having a 2% image ratio (a ratio of toner consumption to a maximum image density) is output as an output image.

Herein, the development efficiency of the patch image is an index defined as follow: Development Efficiency of a Patch Image={(Potential of the Patch Image)−(Potential of the Patch Latent Image)}/{V(devDC)−(Potential of the Patch Latent Image)}. In a case where the potential of the patch image becomes V(devDC), the development efficiency of the patch image becomes 100%, which represents that the patch latent image is completely filled with the toner. The V(devDC) represents the DC voltage of the developing bias.

As illustrated in FIG. 4A, the development efficiency of the patch image which is the development characteristic of the patch image is about 80% at the initial time, and decreases as the output goes by. In order to maintain the image density of the patch image in this state, the toner charging characteristics Q/M is necessarily lowered. Therefore, the TD ratio is increased through the toner replenishment in order to make the Q/M low. As a result, as illustrated in FIG. 4C, the Q/M is lowered from about −25 μC/g at the initial time to about −17 μC/g after passing 2000 sheets.

Figure 5A:
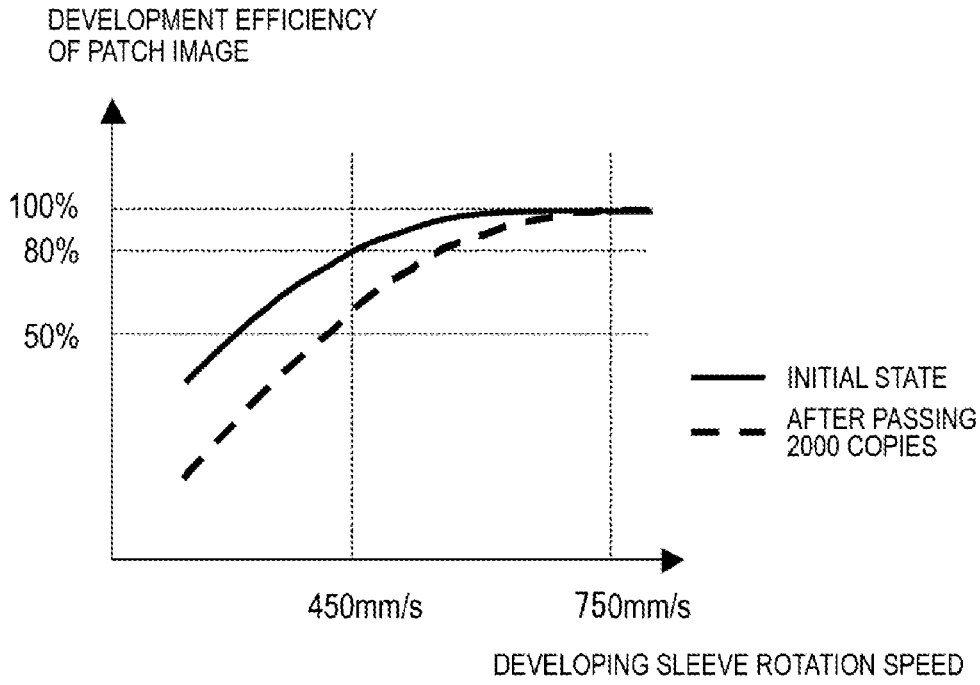
FIG. 5A is a diagram illustrating relations between a developing sleeve rotation speed and development efficiency of a patch image in an initial state and after passing 2000 sheets.
Figure 6A:
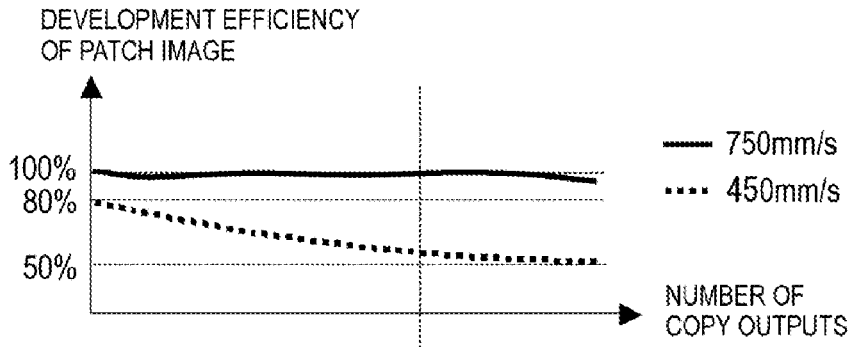
Figure 6B:
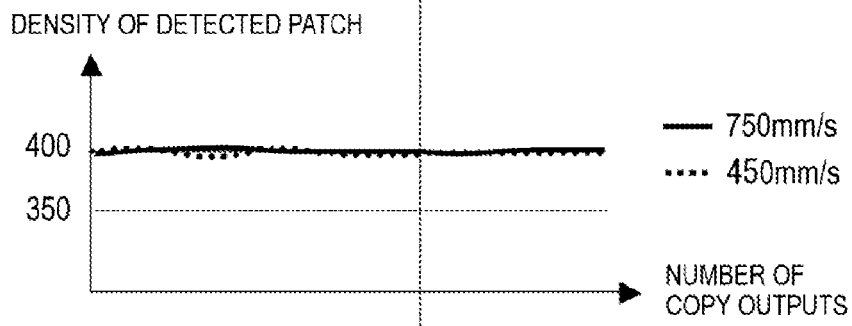
Figure 6C:
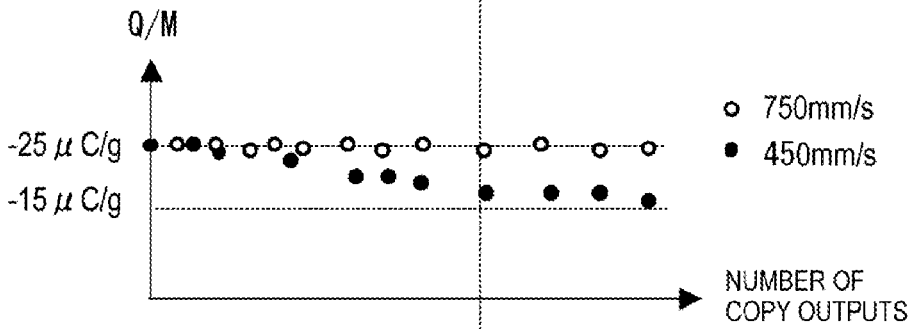
Figure 6D:
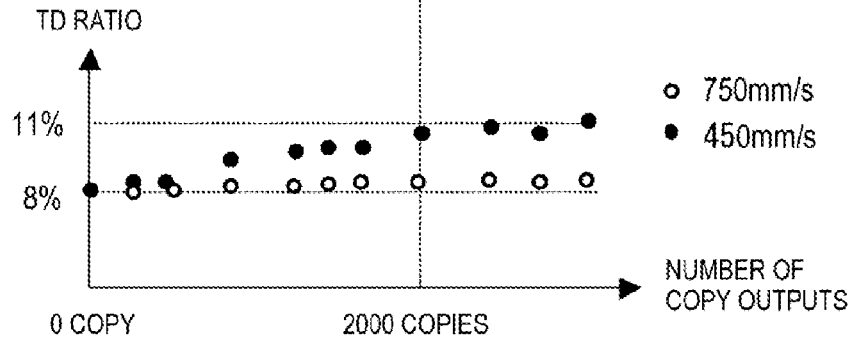

(Relation between Developing Sleeve Rotation Speed and Development Efficiency of Patch Image) FIG. 5A is a diagram illustrating relations between the developing sleeve rotation speed and development efficiency of the patch image in both an initial state and after passing 2000 sheets. As illustrated in FIG. 5A, in both the initial state and after passing 2000 sheets, when the rotation speed of the developing sleeve 232*a* (the developing sleeve rotation speed) increases, the development efficiency of the patch image is improved. This is because the amount of the developer passing through the developing area is increased with the increase in the developing sleeve rotation speed and thus the development efficiency is improved.

In addition, when the developing sleeve rotation speed is 450 mm/s, the development efficiency of the patch image decreases from about 80% in the initial state to about 55% after passing 2000 sheets. This is because the toner in the developer is degraded and toner parting properties between the toner and the carrier become worse.

By increasing the developing sleeve rotation speed, it is possible to bring the development efficiency of the patch image after passing 2000 sheets near to the development efficiency of the patch image in the initial state. When the developing sleeve rotation speed is 750 mm/s, the development efficiency of the patch image can be restored up to almost 100% in both the initial state and after passing 2000 sheets, thereby preventing the variation in the development efficiency of the patch image. Through the variation in the development efficiency of the patch image, the variation in the Q/M also can be prevented and a decrease in the Q/M can be prevented as illustrated in FIG. 4C.

Hitherto, the description has been made in connection with that the developing sleeve rotation speed is increased at the time of forming the patch image to make the development efficiency of the patch image stabilized. The increasing of the developing sleeve rotation speed is effective at the time of forming an image, but there are some negative effects as well.

FIG. 5B is a diagram illustrating relations (improvement and deterioration) between the developing sleeve rotation speed and various items. As illustrated in FIG. 5B, when the developing sleeve rotation speed increases, the patch detection and the image density are stabilized, but the image granularity (roughness), the reproducibility of horizontal lines, toner scattering, and the developer lifespan are worsened.

The image density can be prevented from being lowered by varying the latent image state as an example of a method of stabilizing the image density (see Japanese Patent Laid-Open No. 2007-78896). For this purpose, at the time of forming an image, it is advantageous not to increase the developing sleeve rotation speed.

Although depending on the time of forming a patch image, the driving periods of the developing device 2*a* are significantly changed in both the time of forming the patch image and the time of forming an image according to the toner scattering and the developer lifespan. Specifically, since it is sufficient for the driving period only to detect the image density of the patch image using the patch detection sensor 26*a* at the time of forming the patch image, a length of about 20 mm will be enough for the patch image. However, in a case of the time of forming an image, a length of 210 mm is needed for the width of an A4-size sheet. For this reason, since the driving period of the developing device 2*a* is shortened at the time of forming the patch image, and the influence on the developer lifespan and the toner scattering are less, it is advantageous for the forming of the patch image to increase the developing sleeve rotation speed.

(Control of Developing Sleeve Rotation Speed in the Embodiment) In order to suppress the lowering in the development efficiency of the patch image, in the embodiment, the developing sleeve rotation speed is increased only at the time of forming the patch image for the toner replenishment control (the patch detection ATR), and the developing sleeve rotation speed is not increased at the time of forming an image. FIGS. 6A to 6D illustrate the effect verification results in a case where the developing sleeve rotation speed is increased up to 750 mm/s, only at the time of forming the patch image in the same image output mode as FIGS. 4A to 4D.

As illustrated in FIGS. 6A to 6D, in a case where the developing sleeve rotation speed is 750 mm/s, the development efficiency of the patch image can be maintained near 100%. Therefore, the variation in the density of the patch detection image is caused only by the variation in the Q/M. Accordingly, the Q/M can be maintained near −25 μC/g while the density of the patch detection image is kept constant, so that the effects of the embodiment are verified.

Figure 7A:
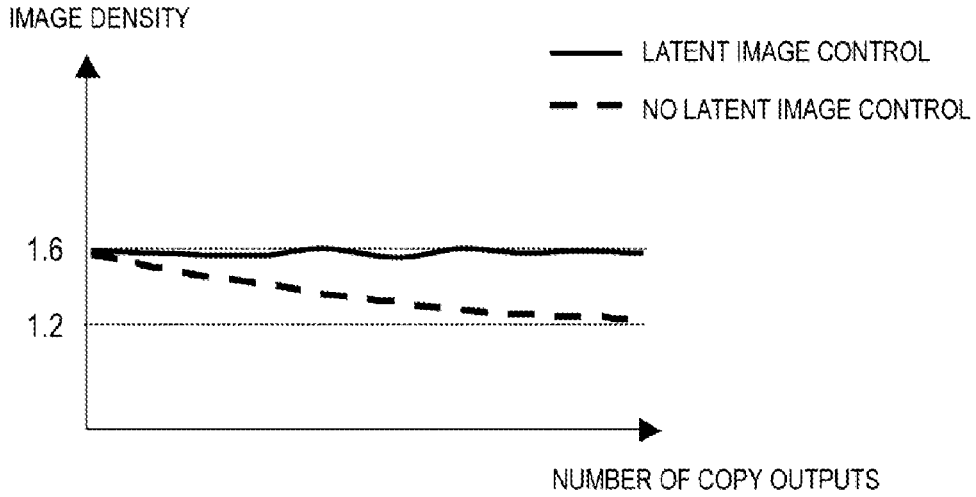
FIGS. 7A and 7B are diagrams illustrating effects obtained through a latent image control.
Figure 7B:
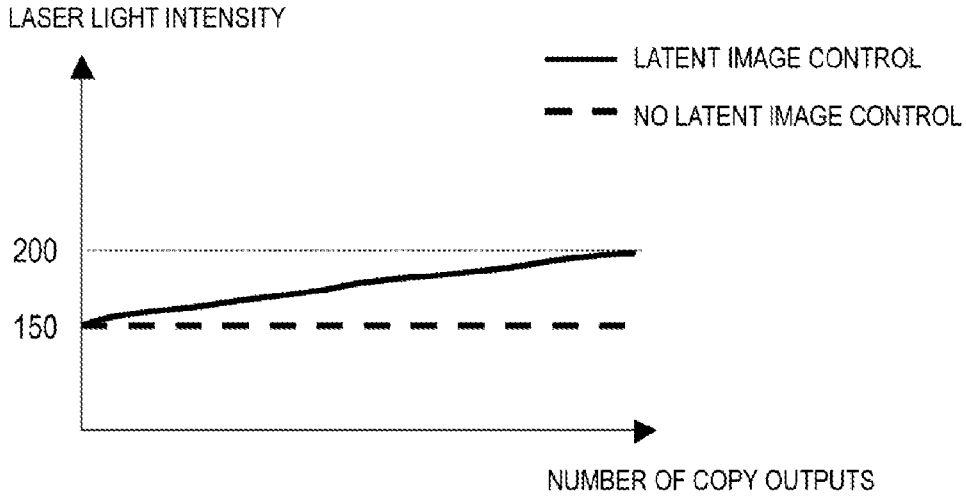

(Relation between Laser Beam Intensity and Image Density) Next, FIGS. 7A and 7B illustrate the relation between the laser beam intensity and the image density in the same mode as FIGS. 4A to 4D. In a case where the laser beam intensity depicted with a dashed line in FIG. 7B is constant, the image density is lowered as depicted with a dashed line in FIG. 7A. This is because since the developing sleeve rotation speed is not increased at the time of forming an image, the development efficiency is lowered. On the other hand, in a case where the laser beam intensity is increased according to the number of copy outputs as depicted with a solid line in FIG. 7B, the electrostatic latent image is thickly formed, so that the image density can be increased and also can be stabilized as depicted with a solid line in FIG. 7A.

(Control of Laser Beam Intensity in the Embodiment) In the embodiment, the image density is detected and the laser beam intensity is changed based on the detection result to make the image density stabilized. Herein, in the embodiment, since the developing sleeve rotation speed is increased to 750 mm/s faster than that at the time of forming a normal image, the density of the patch image using the patch detection ATR may be different from that of a normal image. In addition, the time of forming a normal image in the invention indicates the time of forming the toner image which is formed on a recording material, and is assumed that it is distinguished from the case of the time of forming the patch image for control which is not formed on the recording material.

Figure 8:
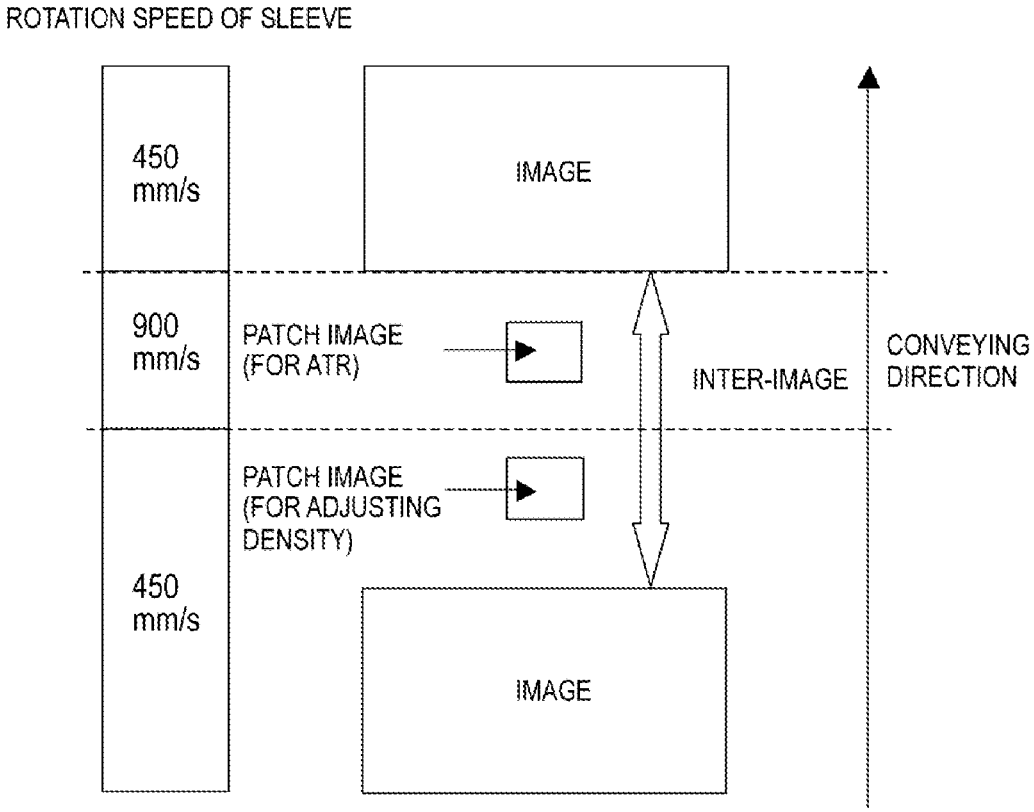
FIG. 8 is a diagram illustrating timing for forming a patch image for density adjustment according to the first embodiment.

In the embodiment, as illustrated in FIG. 8, the patch image for density adjustment other than the patch image for the patch detection ATR is formed at the same developing sleeve rotation speed of 450 mm/s as the time of forming a normal image. Therefore, the density at the time of forming an image can be detected. Then, as illustrated in FIGS. 7A and 7B, it is possible to suppress the lowering in the image density by causing the laser beam intensity to be changed such that the image density of the patch image for density adjustment is kept constant.

Figure 9:
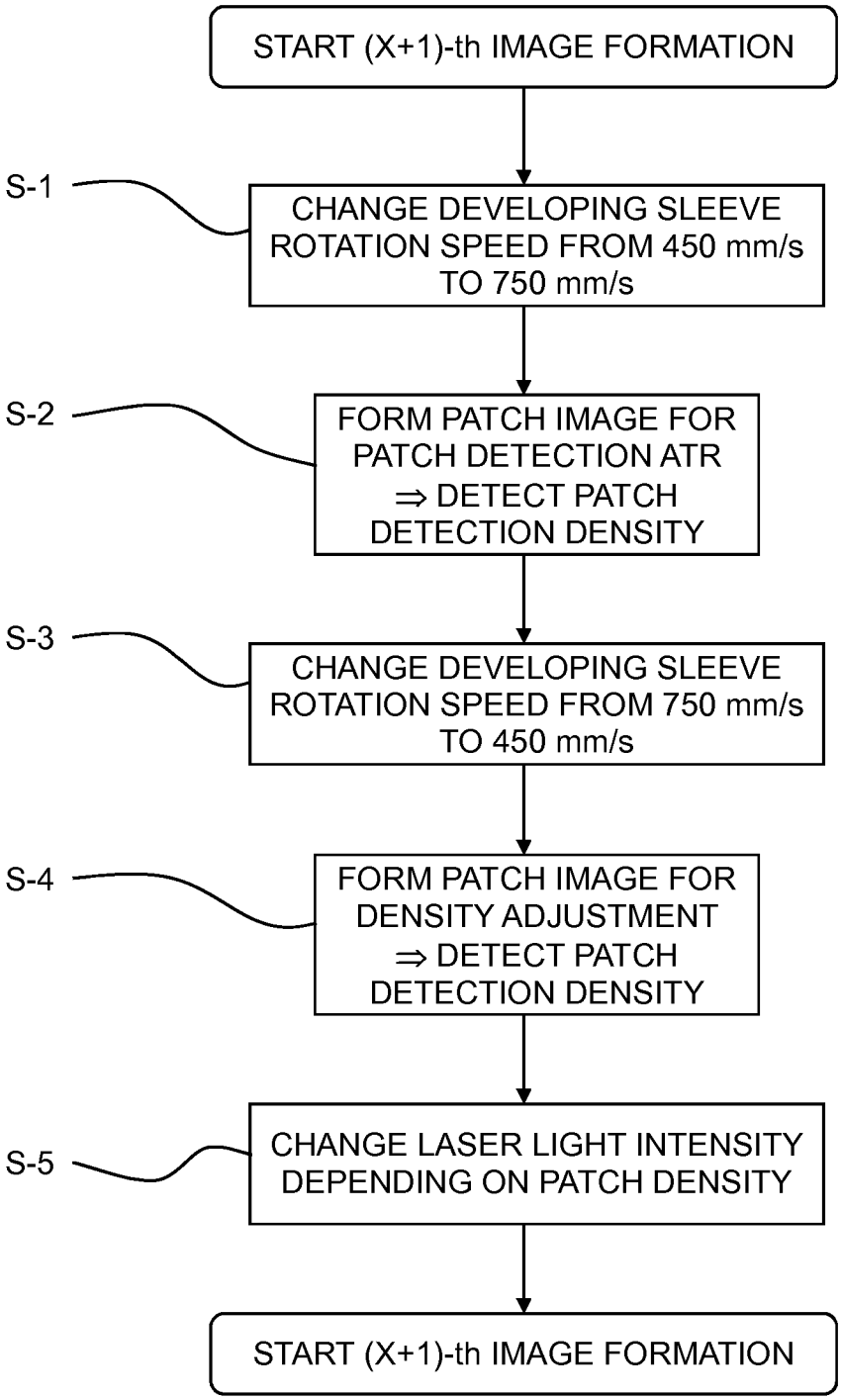
FIG. 9 is a flowchart regarding the patch image for density adjustment according to the first embodiment.

FIG. 9 is a flowchart illustrating a procedure of changing the laser beam intensity using the patch image for the patch detection ATR and the patch image for density adjustment according to the embodiment. As illustrated in FIG. 9, first, after the X-th image is completely formed, the developing sleeve rotation speed is changed from 450 mm/s to 750 mm/s (step S-1). Thereafter, the patch image for the patch detection ATR is formed, and then is detected using the patch detection sensor 26*a* (step S-2). Then, the developing sleeve rotation speed is changed from 750 mm/s to 450 mm/s (step S-3), the patch image for density adjustment is formed and is detected using the patch detection sensor 26*a* (step S-4). The laser beam intensity is changed based on the detection results (step S-5), and the procedure proceeds to the forming of the next (X+1)-th image.

Further, the invention is not limited to the stabilizing of the image density using the laser beam intensity. For example, the electrostatic latent image may be thickly formed by changing a bias voltage applied to the charging roller 11*a* and the developing sleeve 232*a* to stabilize the image density. In the embodiment, the image density is detected to change the laser beam intensity, but the laser beam intensity may be changed by predicting the lowering in the development efficiency.

(Effects) As described above, the developing sleeve rotation speed is increased to form the patch image for the patch detection ATR, and the patch image for density adjustment is formed at the same developing sleeve rotation speed at the time of forming a normal image. Then, the toner replenishment and the laser beam intensity are controlled based on the respective detection results. Accordingly, the variation in the development characteristic of the patch image can be suppressed, and the image degradation and the toner scattering can be suppressed at a low cost.

Second Embodiment

Next, the image forming apparatus according to a second embodiment of the invention will be described with reference to the drawings. The descriptions overlapped with the first embodiment will not be repeated by denoting the same reference numerals.

In the first embodiment, the developing sleeve rotation speed at the time of forming the patch image for the patch detection ATR has been fixed to 750 mm/s, but there is a need to change an optimal developing sleeve rotation speed depending on individual differences of the developing devices in some cases. Therefore, in the embodiment, a "sleeve rotation speed determining mode (a first mode) at the time of developing the patch image" is performed to determine the developing sleeve rotation speed at the time of forming the patch image upon the patch detection initialization. Then, the determined value is set as the developing sleeve rotation speed at the time of forming the patch image.

Figure 10A:
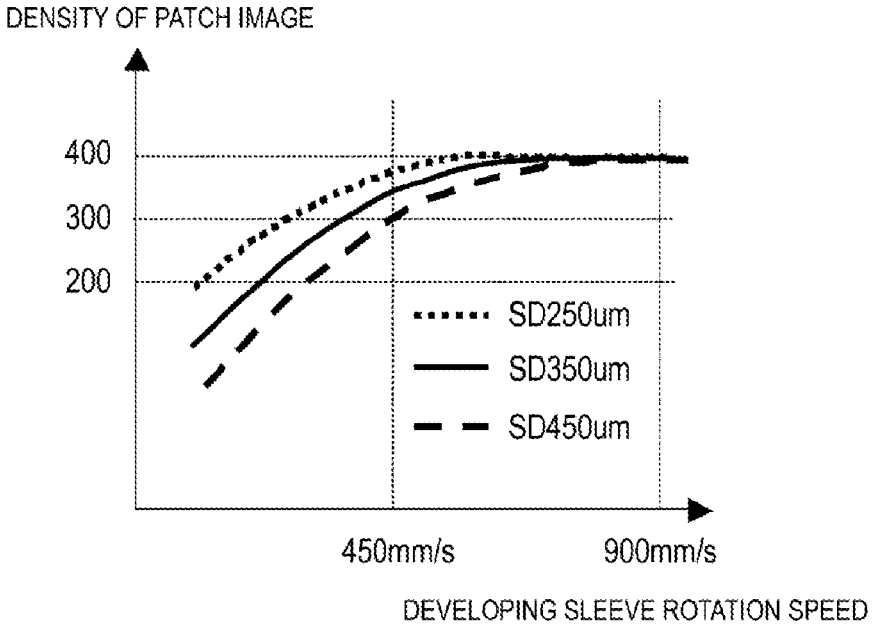
FIG. 10A is a diagram illustrating relations between the density of a patch image and the developing sleeve rotation speed when an SD gap is changed according to a second embodiment.

FIG. 10A illustrates relations between the developing sleeve rotation speed and the image density of the patch image when a distance (an SD gap) between the developing sleeve 232*a* and the photosensitive drum 1*a* is 250 um, 350 um, and 450 um. The SD gap is caused by the individual differences due to various component tolerances when the image forming apparatus is manufactured. Referring to FIG. 10A, it can be seen that as the SD gap is widened, the development efficiency of the patch image is lowered and as a result the image density of the patch image is lowered.

In addition, it can be seen that when the developing sleeve rotation speed is increased, the rotation speed at which the image density of the patch image reaches a stable area near 400 varies depending on the SD gap. Referring to FIG. 10A, when the SD gap is 250 um, the developing sleeve rotation speed is suitable for a good development efficiency of the patch image, but when the SD gap is 450 um, there may be a case in which the development efficiency of the patch image is degraded.

The developing sleeve rotation speed may be set to be very fast in order to make the development efficiency of the patch image enough for any SD gap, but when it becomes too fast, there is a concern that the toner scattering and the degradation in the developer illustrated in FIG. 5B occur, so that these influences may be significant even at the short time of forming the patch image. For example, in a case where the developing sleeve rotation speed exceeds 900 mm/s, the speed becomes equal to or greater by 2 times than that at the time of the developing sleeve rotation speed at the time of forming an image. Therefore, even at the short time of forming the patch image, there is a concern that the influence caused by the toner scattering is substantial.

Therefore, it is advantageous to drop the developing sleeve rotation speed as low as possible in a range of the developing sleeve rotation speed at which the development efficiency of the patch image is good enough. In the embodiment, the developing sleeve rotation speed ranges 450 mm/s to 900 mm/s. In the embodiment, when the developing sleeve rotation speed is 900 mm/s, even when the SD gap is 450 um and a durable agent is used, the image density of the patch image can reach the stable area near 400.

In the embodiment, a "sleeve rotation speed determining mode at the time of developing the patch image" is performed upon the patch detection initialization, in which the image density of the patch image is detected while changing the developing sleeve rotation speed and determines the developing sleeve rotation speed at which the development efficiency of the patch image is good enough based on the detection result. The developing sleeve rotation speed determined as above is used at the time of forming the patch image, so that the patch detection ATR control can be stably performed regardless of the individual difference of the image forming apparatus.

Figure 10B:
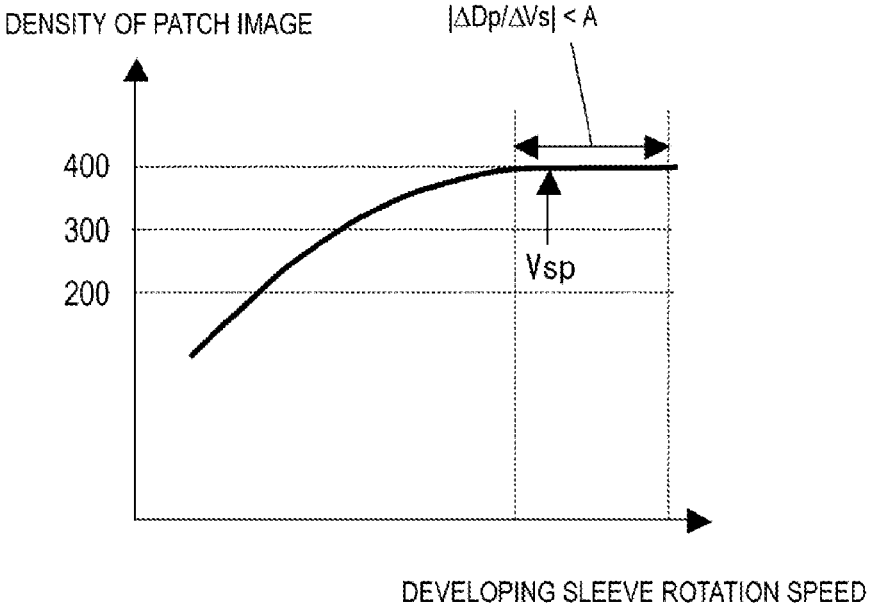
FIG. 10B is a diagram illustrating the region in which $|\Delta Dp/\Delta Vs|<A$ is satisfied according to the second embodiment.
Figure 11:
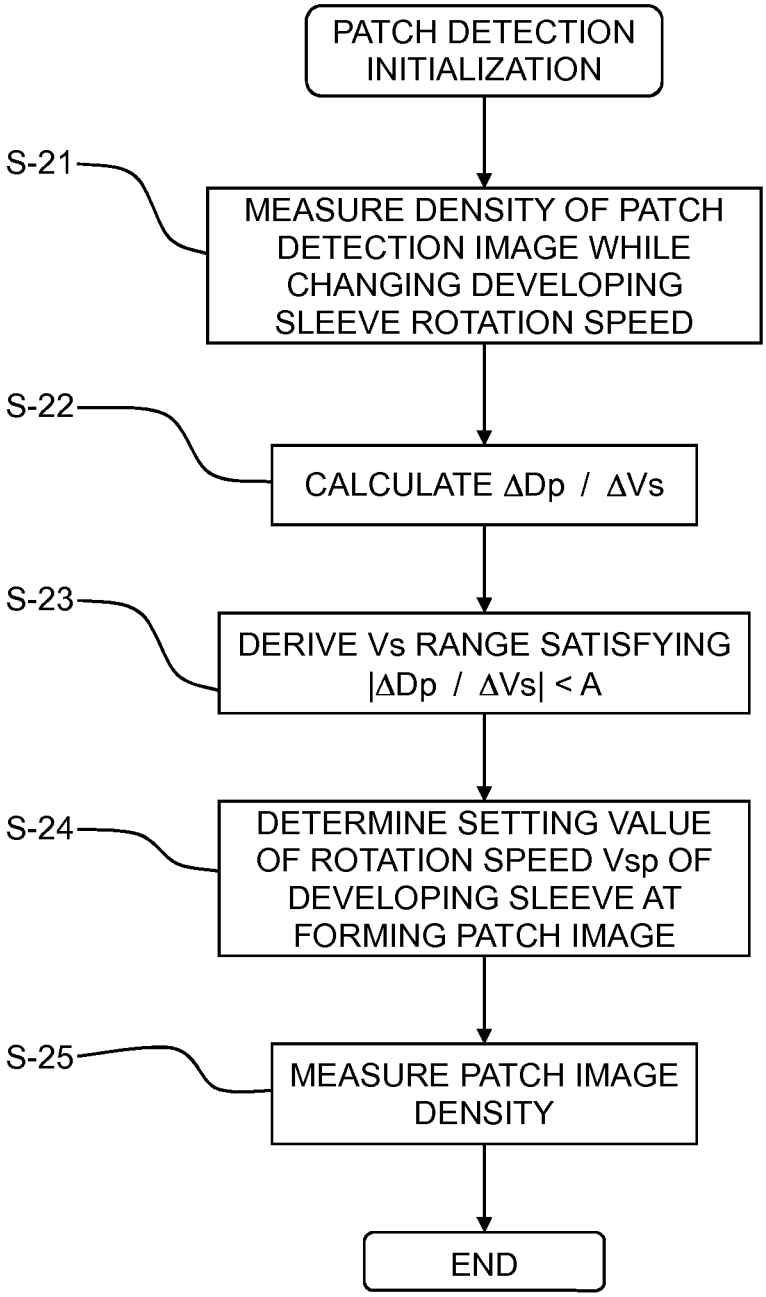
FIG. 11 is a flowchart illustrating a sleeve rotation speed determining mode at the time of developing a patch image according to the second embodiment.

FIG. 11 is a flowchart of the "sleeve rotation speed determining mode at the time of developing the patch image." As illustrated in FIG. 11, when a patch detection initialization is implemented, first, the patch detection image is formed while changing the developing sleeve rotation speed Vs; the density Dp of the patch detection image is measured using the patch detection sensor 26; and then the measured density is stored in the RAM 103 (step S-21). In the embodiment, a change pitch ΔVs of the developing sleeve rotation speed Vs is made at 10 mm/s. The result obtained in step S-21 is depicted in FIG. 10B.

Next, a ratio ΔDp/ΔVs of the variation in the density Dp of the patch detection image to the change pitch ΔVs of the rotation speed Vs of the developing sleeve which is the slope of the curve depicted in FIG. 10B is calculated (step S-22). As the ratio ΔDp/ΔVs becomes close to almost 0, the development efficiency of the patch image comes to near 100%, and there is a need to set the rotation speed Vs of the developing sleeve to fall within the range. In this case, there is no way of satisfying the condition ΔDp/ΔVs=0 due to factors caused by a reading error of the patch detection sensor 26.

In the embodiment, an area satisfying $|\Delta Dp/\Delta Vs|<A$ (a predetermined value) is determined as the setting range of the developing sleeve rotation speed (step S-23). Further, the parameter A is set to 0.5 in consideration of the reading error of the patch detection sensor 26 in the embodiment, but it is no matter that other numerical values are used. In the embodiment, a measurement system is determined to have a tolerance within an error range as long as the density of the patch detection image falls within a range from 395 to 405, and the parameter A is set to 0.5 with the change pitch ΔVs of 10 mm/s. In a case where the parameter A becomes too large, there is a concern that the developing sleeve rotation speed may be set even in a state where the development efficiency of the patch image does not reach the vicinity of 100%, and thus there needs an attention.

Next, the rotation speed Vsp of the developing sleeve at the time of forming the patch image is determined (step S-24). In the embodiment, the rotation speed Vsp is set to a value obtained by adding 30 mm/s to a minimum value satisfying $|\Delta Dp/\Delta Vs|<A$. The reason why the addition is made is that in a case where the rotation speed Vsp is set to the minimum value satisfying $\Delta\Delta Dp/\Delta Vs\Delta<A$, there is a concern that the development efficiency of the patch image is lowered when the images in FIGS. 4A to 4D and FIGS. 7A and 7B are output, so that 30 mm/s is added as a safety coefficient. The added value (the safety coefficient) may be set to another one. The minimum value satisfying $|\Delta Dp/\Delta Vs|<A$ in FIG. 10B is 670 mm/s, and thus the rotation speed Vsp is set to 700 mm/s which is stored in the RAM 103.

Finally, the patch detection image is formed under the condition of Vsp=700 mm/s. Further, the density Dp(init) of the patch image Q at the developer at the initial time is measured using the patch detection sensor 26. Then, the result is stored in the RAM 103, and the measurement ends (step S-25).

Even in a case where the rotation speed Vsp of the developing sleeve determined in the flowchart of FIG. 11 is used, the same effects as those of FIGS. 6A to 6D and FIGS. 7A and 7B are obtained, so that the image forming apparatus can be stably operated.

Third Embodiment

Next, the image forming apparatus according to a third embodiment of the invention will be described with reference to the drawings. The descriptions overlapped with the first embodiment will not be repeated by denoting the same reference numerals.

In the first and the second embodiments, the developing sleeve rotation speed is increased only at the time of forming the patch image, so that the development efficiency of the patch image can be stabilized and the Q/M can be maintained constant. In the embodiment, the development efficiency of the patch image is stabilized by increasing the Vpp of the AC voltage (DevAC) in the developing bias instead of the developing sleeve rotation speed.

Figure 12A:
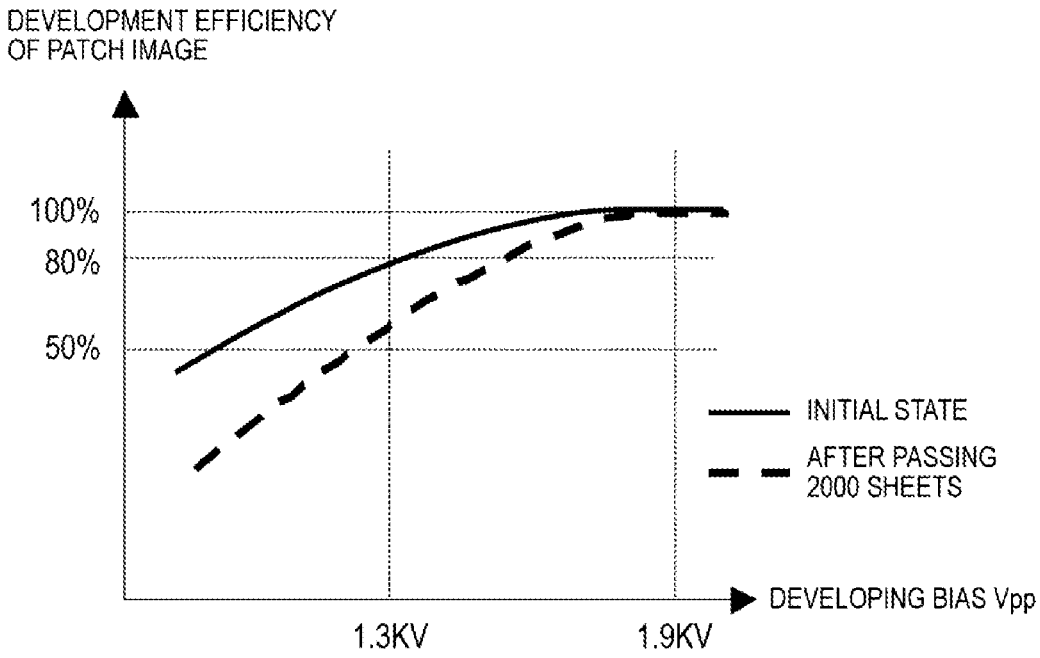
FIG. 12A is a diagram illustrating a relation between development efficiency of a patch image and a developing bias Vpp according to a third embodiment.

FIG. 12A illustrates a relation between the Vpp (the developing bias Vpp) of the AC voltage (DevAC) in the developing bias and the development efficiency of the patch image in both the initial state and after passing 2000 sheets. As illustrated in FIG. 12A, even in both the initial state and after passing 2000 sheets, the development efficiency of the patch image is improved as the developing bias Vpp increases. This is because the electric field strength increases in the developing area by increasing the developing bias Vpp so that the development efficiency is improved.

When the developing bias Vpp is 1.3 KV, the development efficiency of the patch image which has been about 80% in the initial state decreases down to about 55% after passing 2000 sheets. As a cause of the decrease, since the developing device is operated by passing the sheets, the toner in the developer is degraded and the toner parting properties between the toner and the carrier become worse. Herein, the separation and embedding of an external additive on the surfaces of the toner particles are main causes of the degradation in the toner, and other causes may be introduced.

However, even in the state after passing 2000 sheets, the development efficiency of the patch image can be restored to a state having no difference from the initial state by increasing the developing bias Vpp. When the developing bias Vpp is 1.9 KV, the development efficiency of the patch image can be increased up to almost 100% in both the initial state and after passing 2000 sheets, and thus the variation in the development efficiency of the patch image can be suppressed. Since the variation in the development efficiency of the patch image is suppressed, the variation in the Q/M also can be suppressed, thereby being able to suppress the lowering in the Q/M as illustrated in FIG. 4C.

As described above, the development efficiency of the patch image can be stabilized by increasing the developing bias Vpp at the time of forming the patch image. However, in a case where the developing bias Vpp is increased at the time of forming an image, not only positive effects are gained but also negative effects arise.

FIG. 12B is a diagram illustrating relations of improvement and deterioration appearing between the developing bias Vpp and various items. As illustrated in FIG. 12B, the patch detection and the image density are stabilized by increasing the developing bias Vpp, but the deterioration arise in terms of an image defect called a ring mark, fogging on a white base, and the toner scattering. The lowering in the image density can be prevented by making the latent image state varied as an example of a method of stabilizing the image density. Therefore, it is advantageous not to increase the developing bias Vpp at the time of forming an image.

Figure 13A:
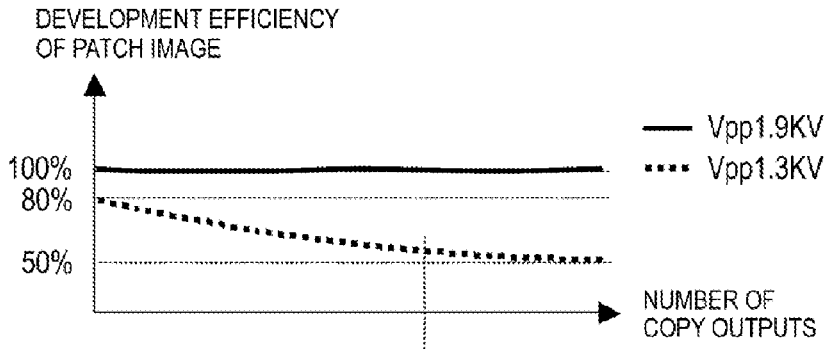
Figure 13B:
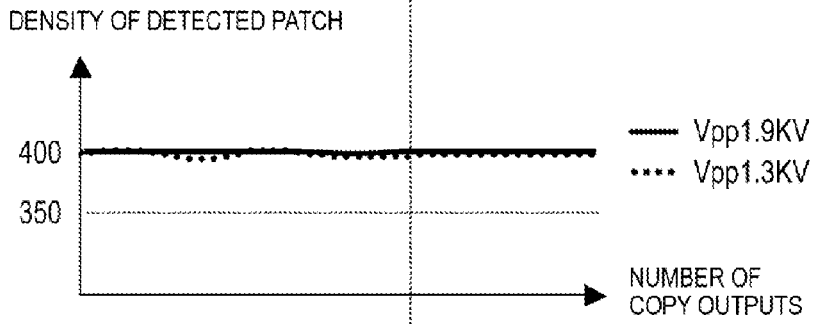
Figure 13C:
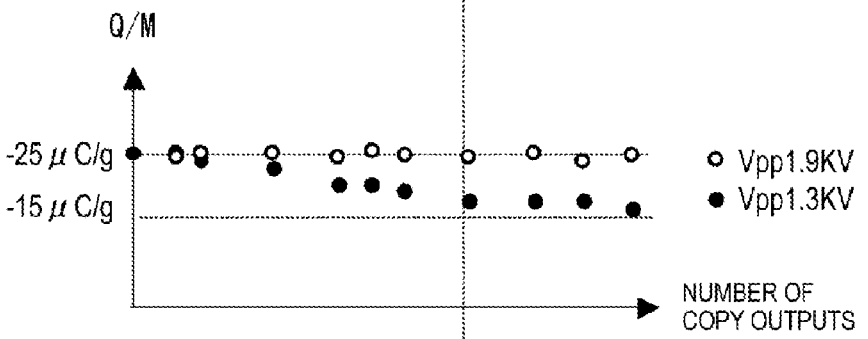
Figure 13D:
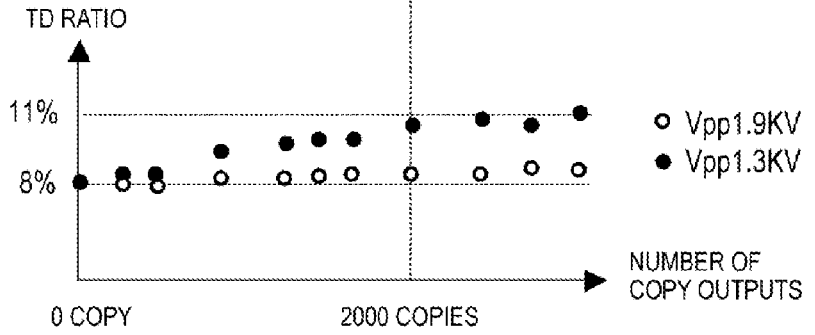

FIGS. 13A to 13D illustrate the effect verification results in a case where the developing bias Vpp is increased up to 1.9 KV only at the time of forming the patch image in the same image output mode as FIGS. 4A to 4D. As illustrated in FIG. 13A, in a case where the developing bias Vpp is 1.9 KV, the development efficiency of the patch image can be maintained near 100%. As illustrated in FIG. 13C, also the Q/M can be maintained near −25 μC/g. Therefore, the effect of the embodiment is verified.

Figure 14:
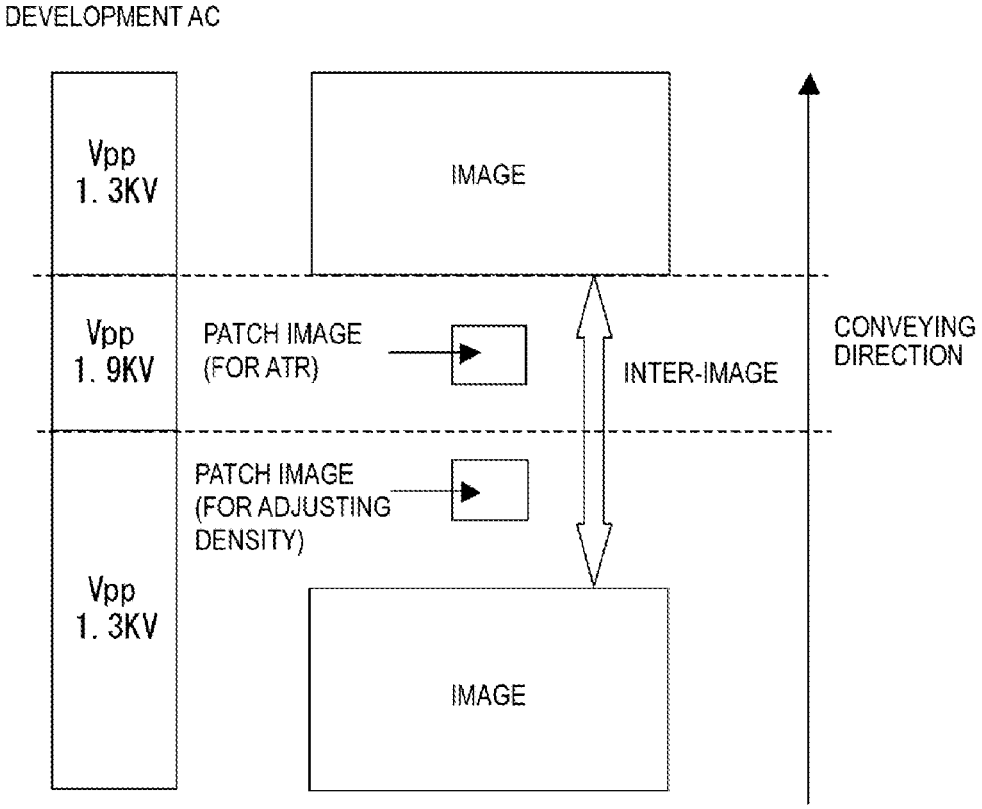
FIG. 14 is a diagram illustrating timing for forming a patch image for density adjustment according to the third embodiment.

In the embodiment, as illustrated in FIG. 14, the patch image for density adjustment other than the patch image for the patch detection ATR is formed. At this time, the developing bias Vpp is set to 1.3 KV at the time of forming the patch image for density adjustment. Then, the image density at the time of forming an image is detected using the patch detection sensor 26 to change the laser beam intensity, and thus the image density at the time of forming an image can be stabilized as illustrated in FIGS. 7A and 7B.

Figure 15:
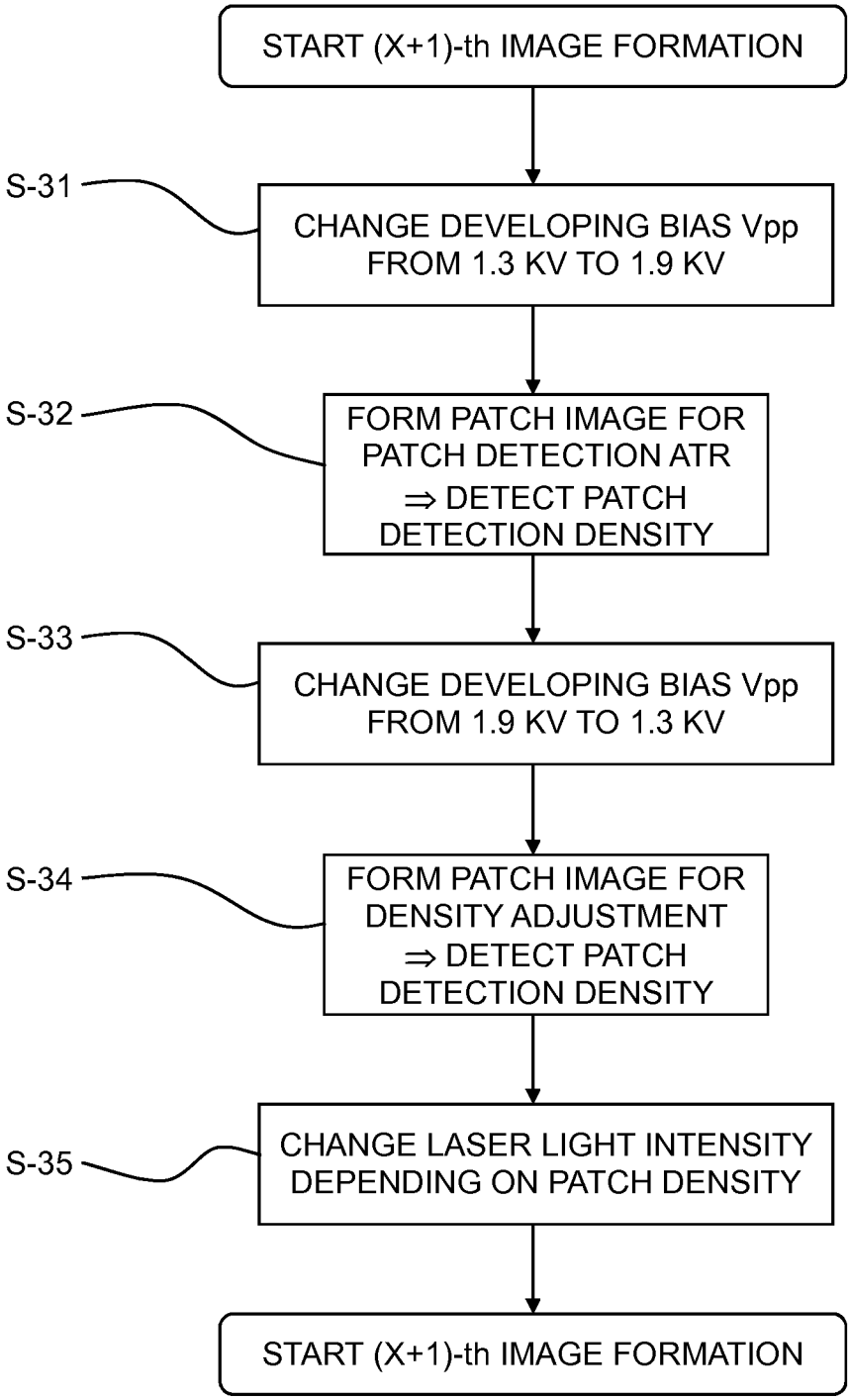
FIG. 15 is a flowchart regarding the patch image for density adjustment according to the third embodiment.

FIG. 15 is a flowchart illustrating a procedure of changing the laser beam intensity using the patch image for the patch detection ATR and the patch image for density adjustment according to the embodiment. As illustrated in FIG. 15, first, after the X-th image is completely formed, the developing bias Vpp is changed from 1.3 KV to 1.9 KV (step S-31). Then, the patch image for the patch detection ATR is formed, and then is detected using the patch detection sensor 26 (step S-32). Thereafter, the developing sleeve rotation speed is changed from 1.9 KV to 1.3 KV (step S-33), the patch image for density adjustment is formed and is detected using the patch detection sensor 26 (step S-34). The laser beam intensity is changed based on the detection results (step S-35), and the procedure proceeds to the forming of the next (X+1)-th image.

Fourth Embodiment

Next, the image forming apparatus according to a fourth embodiment of the invention will be described with reference to the drawings. The descriptions overlapped with the first embodiment will not be repeated by denoting the same reference numerals.

In the third embodiment, the development efficiency of the patch image and the Q/M can be stabilized by increasing the developing bias Vpp up to 1.9 KV at the time of forming the patch image. In the embodiment, upon the patch detection initialization, the "developing bias Vpp determining mode (the second mode) at the time of developing the patch image" is performed to determine the developing bias Vpp at the time of forming the patch image. Further, the determined value is used as the developing bias Vpp at the time of forming the patch image.

Figure 16A:
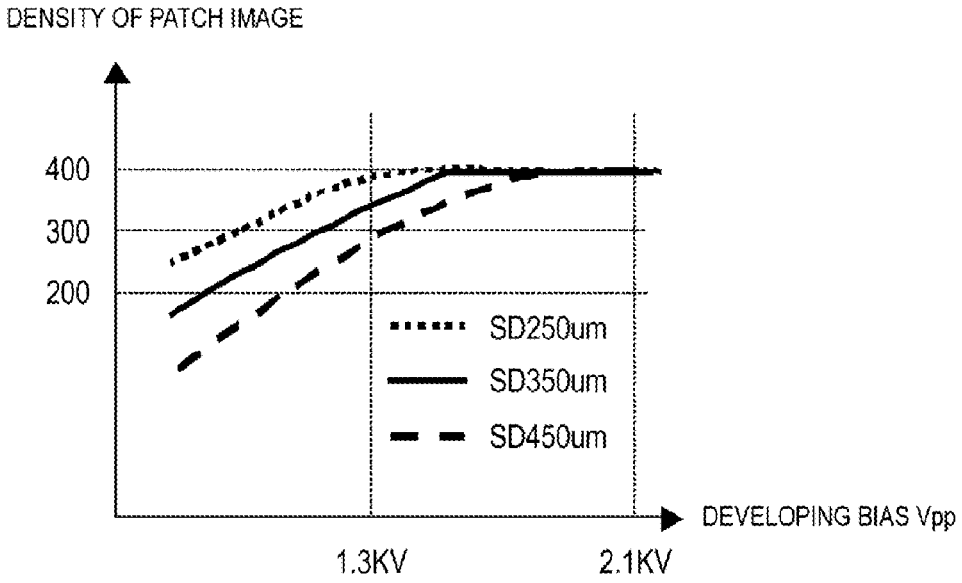
FIG. 16A is a diagram illustrating relations between the density of a patch image and the developing bias Vpp when an SD gap is changed according to a fourth embodiment.

FIG. 16A illustrates relations between the developing bias Vpp and the image density of the patch image when a distance (the SD gap) between the developing sleeve 232 and the photosensitive drum 1 is 250, 350, and 450 um. The SD gap is caused by the individual differences due to various component tolerances when the image forming apparatus is manufactured. As illustrated in FIG. 16A, it can be seen that as the SD gap is widened, the development efficiency of the patch image is lowered and as a result the image density of the patch image is lowered. In addition, it can be seen that when the developing bias Vpp is increased, the rotation speed at which the image density of the patch image reaches a stable area near 400 varies depending on the SD gap.

The developing bias Vpp may be set to be larger in order to make the development efficiency of the patch image enough for any SD gap. However, in a case where the developing bias Vpp increases too much when the SD gap is narrow, there is a concern that the ring mark, the fogging on a white base, and the toner scattering illustrated in FIG. 12B occur, so that these influences may be significant even at the short time of forming the patch image.

In the embodiment, a "developing bias Vpp determining mode at the time of developing the patch image" is performed upon the patch detection initialization, in which the image density of the patch image is detected while changing the developing bias Vpp and determines the developing bias Vpp at which the development efficiency of the patch image is good enough based on the detection result. The developing bias Vpp determined as above is used at the time of forming the patch image, so that the patch detection ATR control can be stably performed regardless of the individual difference of the image forming apparatus.

Figure 16B:
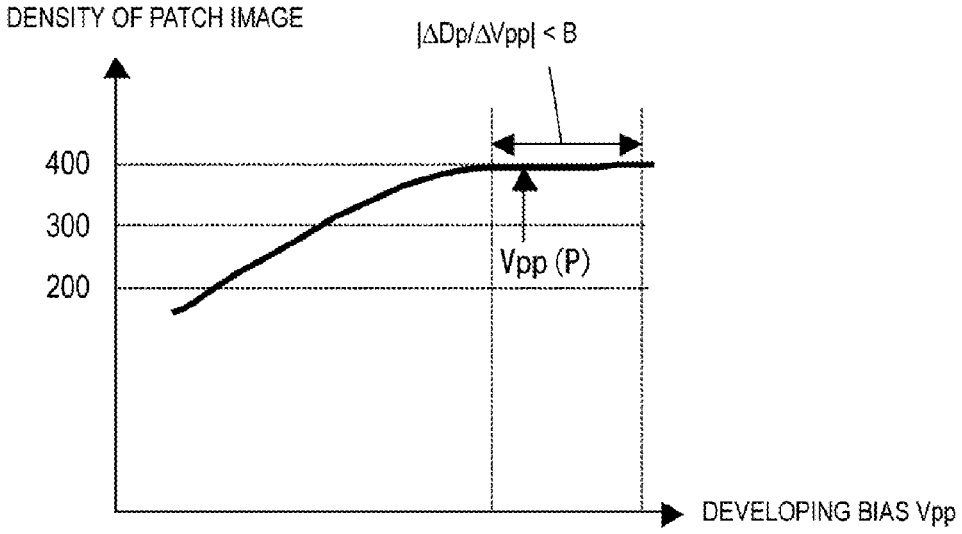
FIG. 16B is a diagram illustrating the region in which $|\Delta Dp/\Delta$Developing bias Vpp$|<B$ is satisfied according to the fourth embodiment.
Figure 17:
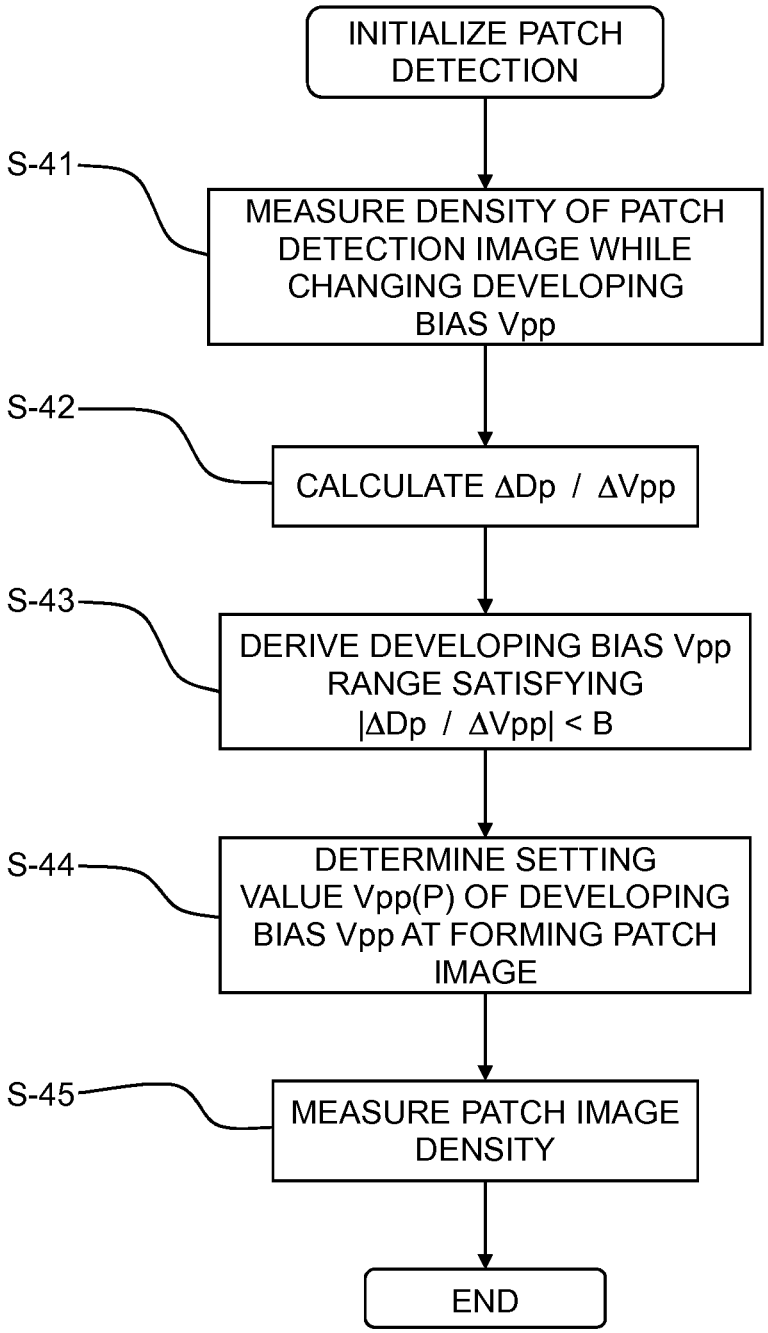
FIG. 17 is a flowchart illustrating a developing bias determining mode at the time of developing a patch image according to the fourth embodiment.

FIG. 17 is a flowchart of the "developing bias Vpp determining mode at the time of developing the patch image." As illustrated in FIG. 17, when a patch detection initialization is performed, first, the patch detection image is formed while changing the developing bias Vpp; the density Dp of the patch detection image is measured using the patch detection sensor 26; and then the measured density is stored in the RAM 103 (step S-41). In the embodiment, a change pitch ΔVpp of the developing bias Vpp is made at 0.05 KV. The result obtained in step S-41 is depicted in FIG. 16B.

Next, a ratio ΔDp/ΔVpp of the variation in the density Dp of the patch detection image to the change pitch ΔVpp of the developing bias Vpp of the developing sleeve which is the slope of the curve depicted in FIG. 16B is calculated (step S-42). As the ratio ΔDp/ΔVpp becomes close to substantially 0, the development efficiency of the patch image comes to near 100%, and there is a need to set the developing bias Vpp of the developing sleeve to fall within the range. In this case, it is not likely to satisfy the condition ΔDp/ΔVpp=0 due to factors caused by a reading error of the patch detection sensor 26.

In the embodiment, an area satisfying |Δpp/ΔVpp|<B (a predetermined value) is determined as the setting range of the developing bias Vpp (step S-43). Herein, the parameter B is set to 100 in consideration of the reading error of the patch detection sensor 26 in the embodiment, but it is no matter that other numerical values are used. In the embodiment, a measurement system is determined to have a tolerance within an error range as long as the density of the patch detection image falls within a range from 395 to 405, and the parameter B is set to 100 with the change pitch ΔVpp of 0.05 KV. In a case where the parameter B becomes too large, there is a concern that the developing bias Vpp may be set even in a state where the development efficiency of the patch image does not reach the vicinity of 100%, and thus there needs an attention.

Next, the developing bias Vpp (the developing bias Vpp (P)) at the time of forming the patch image is determined (step S-44). In the embodiment, the developing bias Vpp(P) is set to a value obtained by adding 0.10 KV to a minimum value satisfying |ΔDp/ΔVpp|<B.

The reason why the addition is made is that in a case where the developing bias Vpp(P) is set to the minimum value satisfying |ΔDp/ΔVpp|<B, there is a concern that the development efficiency of the patch image is lowered when the images in FIGS. 4A to 4D are output, so that 0.1 KV is added as a safety coefficient. The added value may be set to another one. The minimum value satisfying |ΔDp/ΔVpp|<B in FIG. 16B is 1.75 KV, and thus the developing bias Vpp(P) is set to 1.85 KV which is stored in the RAM 103.

Finally, the patch detection image is formed under the condition of Vpp(P)=1.85 KV. Further, the density Dp(init) of the patch image Q at the developer at the initial time is measured using the patch detection sensor 26. Then, the result is stored in the RAM 103, and the measurement ends (step S-45).

Even in a case the developing bias Vpp(P) of the developing sleeve determined in the flowchart of FIG. 17 is used, the same effects as those of FIGS. 7A and 7B and FIG. 12B are obtained, so that the image forming apparatus can be stably operated.

Fifth Embodiment

Next, the image forming apparatus according to a fifth embodiment of the invention will be described with reference to the drawings. The descriptions overlapped with the first embodiment will not be repeated by denoting the same reference numerals.

The development efficiency of the patch image can be stabilized by increasing the developing sleeve rotation speed in the first and the second embodiments or by increasing the developing bias Vpp in the third and the fourth embodiments, so that the Q/M can be maintained constant. In the embodiment, the development efficiency of the patch image is stabilized by increasing both the developing sleeve rotation speed and the developing bias Vpp at the time of forming the patch image so as to maintain the Q/M constant.

According to the embodiment, since both the developing sleeve rotation speed and the developing bias Vpp are both increased, it is possible to maintain the Q/M without increasing the respective setting values as much as those in the first to the fourth embodiments. Therefore, the increasing level of the developing sleeve rotation speed and the developing bias Vpp are suppressed, and the influence of the deterioration factors caused when the developing sleeve rotation speed and the developing bias Vpp illustrated in FIG. 5B and FIG. 12B are increased can be suppressed further more compared with the first to the fourth embodiments.

In the embodiment, at the time of forming the patch image, the developing sleeve rotation speed has been set to 600 mm/s, and the developing bias Vpp has been set to 1.6 KV. The increasing levels to be set for the developing sleeve rotation speed and the developing bias Vpp may be allocated in other ratios. Therefore, the same Q/M as the first to the fourth embodiments can be maintained constant, and it is possible to suppress the increasing levels to be set for the developing sleeve rotation speed and the developing bias Vpp.

Further, similarly to the second and the fourth embodiments, the "sleeve rotation speed determining mode at the time of developing the patch image" and the "developing bias Vpp determining mode at the time of forming the patch image" may also be performed in the embodiment. Therefore, it is possible to perform the stabilized patch detection ATR control regardless of the individual differences of the image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-262595, filed Nov. 30, 2011, which is hereby incorporated by reference herein in its entirety.

What is claimed is:

1. An image forming apparatus comprising:

an image bearing member;

a developing device which includes a toner bearing member which supplies toner to an electrostatic latent image formed on the image bearing member and develops a toner image;

a transfer device which transfers the toner image formed by the toner bearing member onto a recording material;

an image density sensor which detects an image density of a reference toner image for controlling the image density developed by the toner bearing member;

a toner replenishment device which replenishes the developing device with the toner based on the detection result of the image density sensor; and a controller which makes a control such that a rotation speed of the toner bearing member at the time of forming the reference toner image is higher than the rotation speed of the toner bearing member at the time of forming a normal image.

2. An image forming apparatus comprising:

an image bearing member;

a developing device which includes a toner bearing member which supplies toner to an electrostatic latent image formed on the image bearing member and develops a toner image;

a transfer device which transfers the toner image formed by the toner bearing member onto a recording material;

an image density sensor which detects an image density of a reference toner image for controlling the image density developed by the toner bearing member;

a toner replenishment device which replenishes the developing device with the toner based on the detection result of the image density sensor; and a bias controller which makes a control such that an amplitude of a developing bias applied to the toner bearing member at the time of forming the reference toner image is larger than the amplitude of the developing bias applied to the toner bearing member at the time of forming a normal image.

3. The image forming apparatus according to claim 1, wherein the controller performs a speed determining mode in which densities Dp of a plurality of reference toner images are made while the rotation speed Vs of the toner bearing member is changed, and the rotation speed of the toner bearing member at the time of forming the reference toner image is determined based on the detection result detected by the image density sensor detecting the plurality of reference toner images.

4. The image forming apparatus according to claim 2, wherein the controller performs a developing bias determining mode in which densities Dp of a plurality of reference toner images are made while the amplitude of a developing bias applied to the toner bearing member is changed, and the developing bias applied to the toner bearing member at the time of forming the reference toner image is determined based on the detection result detected by the image density sensor detecting the plurality of reference toner images.

5. An image forming apparatus comprising:

an image bearing member;

a developing device which includes a toner bearing member which supplies toner to an electrostatic latent image formed on the image bearing member and develops a toner image;

a transfer device which transfers the toner image formed by the toner bearing member onto a recording material;

an image density sensor which detects an image density of a reference toner image for controlling the image density developed by the toner bearing member;

a toner replenishment device which replenishes the developing device with the toner based on the detection result of the image density sensor; and a controller which makes a control on the developing device such that a development efficiency is higher at the time of forming the reference toner image than at the time of forming of a normal image.

* * * * *